US006116122A

United States Patent [19]

Lien-Sheng

[11] Patent Number: 6,116,122

[45] Date of Patent: Sep. 12, 2000

[54] RATCHET TOOL

[76] Inventor: Chen Lien-Sheng, No. 51, Chang-Ban Lane, Guang-Fu Li, Shin-Tun, Taichung, Taiwan

[21] Appl. No.: 09/336,569

[22] Filed: Jun. 21, 1999

[51] Int. Cl.[7] ..... B25B 23/16

[52] U.S. Cl. ..... 81/177.1

[58] Field of Search ..... 81/62, 58, 177.1, 81/177.2, 177.3, 177.5, 177.8, 489, 490, 491, 492, 60, 61, 63, 63.1, 119, 124.3, 124.7, 900; 16/110 R, 116 R

[56] References Cited

U.S. PATENT DOCUMENTS

| | | | |
|---|---|---|---|
| 904,257 | 11/1908 | Haldorsen et al. | 81/62 |
| 2,769,360 | 11/1956 | Cottrell et al. | 81/121 |
| 4,276,791 | 7/1981 | Thompson | 81/62 |
| 4,819,521 | 4/1989 | Lang | 81/63 |
| 4,901,608 | 2/1990 | Shieh | 81/177.8 |
| 5,964,129 | 10/1999 | Shiao | 81/63.2 |

*Primary Examiner*—Timothy V. Eley
*Assistant Examiner*—Dung Van Nguyen
*Attorney, Agent, or Firm*—Charles E. Baxley, Esq.

[57] ABSTRACT

A ratchet tool includes a head, a neck extending inclinedly from the head and a handle connected the neck. The handle has a ridge extending therefrom and two longitudinal grooves are defined between the two sides of the ridge and the outside of the handle. Grip material is wrapped the handle portion with the top surface of the ridge being located slightly higher than the surface of the grip material received in the two longitudinal grooves. The top surface of the ridge portion is visible in the grip material.

5 Claims, 7 Drawing Sheets

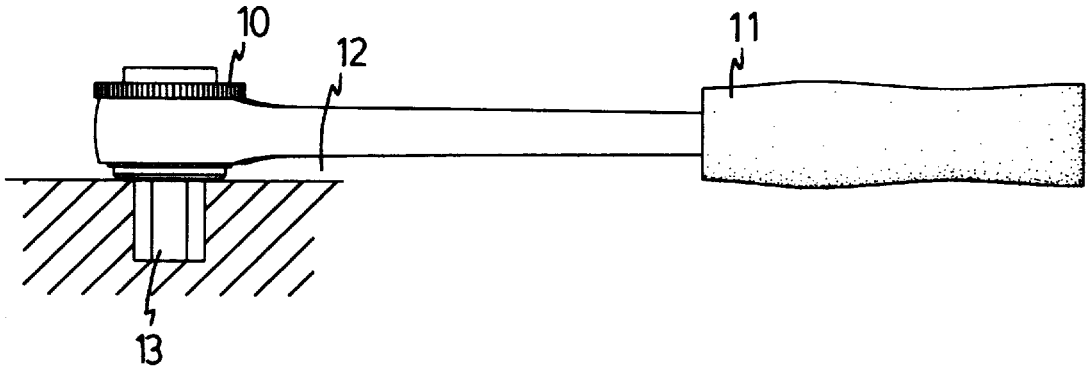
F·I G.9
PRIOR ART

RATCHET TOOL

FIELD OF THE INVENTION

The present invention relates to a ratchet tool, and more particularly, to a ratchet tool having a handle, a neck inclinedly connected to the handle and a head extending horizontally from the neck. The handle has a ridge extending from one of two sides thereof and a grip material attached to the handle wherein the top surface of the ridge is flush with the grip material.

BACKGROUND OF THE INVENTION

A conventional ratchet tool is shown in FIG. 8 and includes a shank with a head portion 10 and a handle portion, the head portion 10 and the handle portion respectively located at two ends of the shank. The handle portion has a grip 11 mounted thereto so as to provide proper frictional force when held by a user's hand. As shown in FIG. 9, because the shank generally is a straight bar so that when using the ratchet to tighten or loosen a bolt in a recess defined in a surface 12, the socket 13 mounted to the head portion can be inserted into the recess and engaged with the bolt. However, if there are other objects extending from the surface 12, then the shank cannot be used because the objects on the surface limit the operation space of the shank.

Furthermore, the grip 11 generally is securely mounted to the handle portion by receiving the handle portion in a sleeve-like grip 11. Some of the grips 11 are mounted to the handle portion by way of plastic injection molding. Both of the two ways make the handle portion completely be received in the grip 11 so that the customers cannot see the handle portion. The customers have an intention to know what is the handle portion of the ratchet tool in the grip 11 look like. That is to say, the material of the handle portion attracts the customers so that if the handle portion of the ratchet tool is visible, the customers tend to buy the tools rather than the tools whose handle portion cannot seen. Nevertheless, if the grip 11 is made to let a surface of the handle portion be flush with the material of the grip 11, too much flash material is formed on the position where the grip material abutting the handle portion. Therefore, the manufacturers have to take time to remove the flash material.

The present invention intends to provide a ratchet tool which has a head and a handle with an inclined neck connected therebetween so that there is a space defined between the handle and the surface on which objects are located. The handle of the ratchet tool has a ridge extending therefrom so that the grip material is attached to the handle with the top surface of the ridge being flush with the grip material.

The top surface of the handle portion of the present invention is exposed in the grip material and no flash material formed during the manufacturing process.

SUMMARY OF THE INVENTION

In accordance with one aspect of the present invention, the ratchet tool includes a head, a neck extending inclinedly from the head, and a handle connected to the neck, The handle has a ridge extending radially outward therefrom so as to define two longitudinal grooves between the two sides of the ridge and the handle. Grip material is attached to the handle and received in the two longitudinal grooves. A surface connected between the two sides of the ridge is located higher than the surface of the grip material in the two grooves.

The primary object of the present invention is to provide a ratchet tool wherein the handle is located higher than the head of the ratchet tool.

Another object of the present invention is to provide a ratchet tool whose handle has a ridge and the top surface of the ridge is visible in the grip material attached to the handle.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 9 is an illustrative view to show the conventional ratchet tool is operated.

DETAILED DESCRIPTION OF THE PREFERRED EMBODIMENTS

Figure 1:
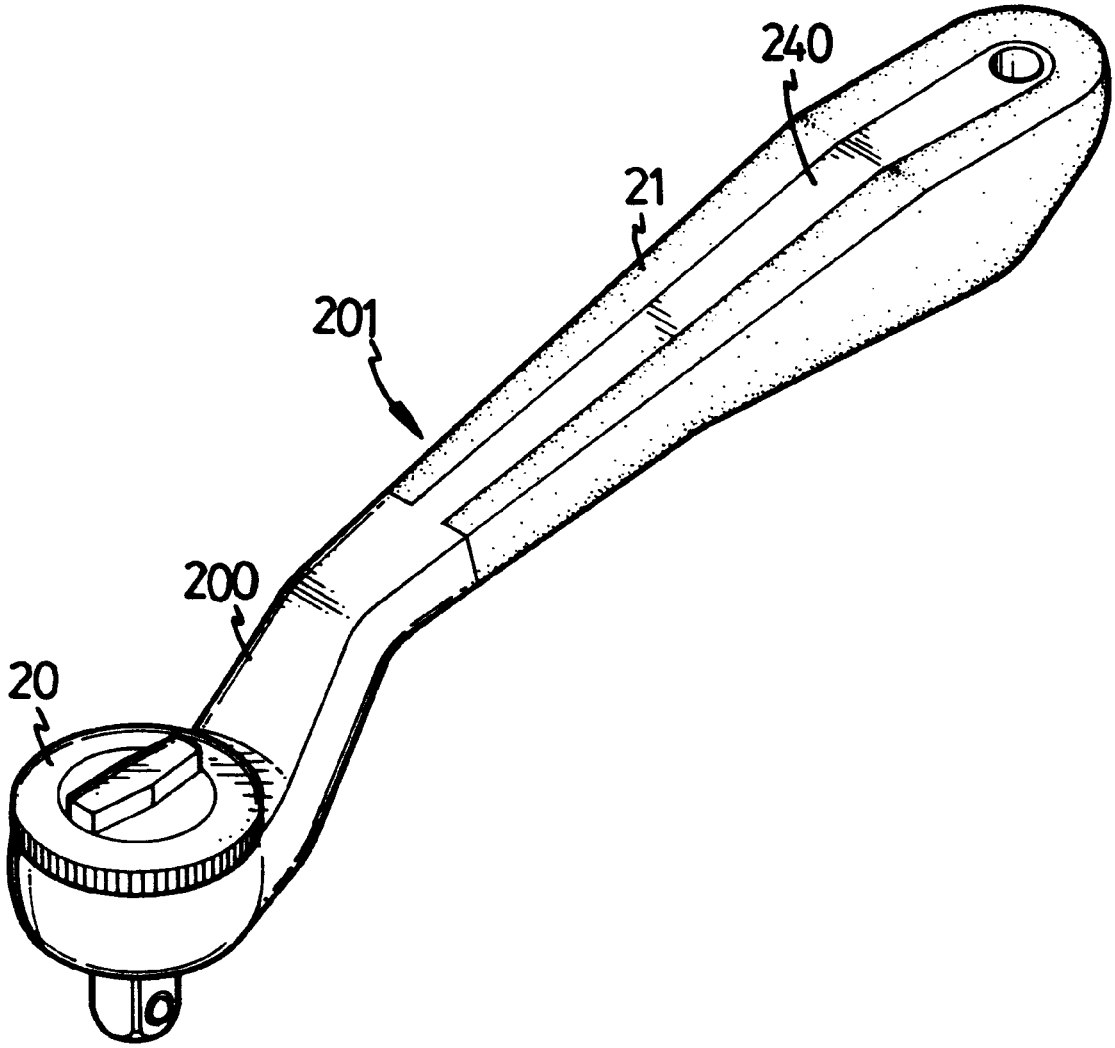
FIG. 1 is a perspective view of the ratchet tool in accordance with the present invention.
Figure 2:
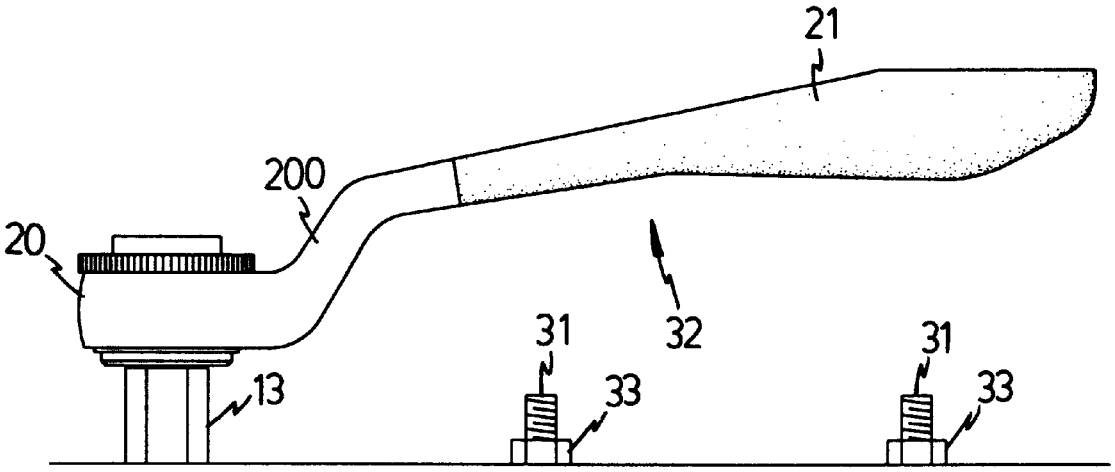
FIG. 2 is an illustrative view to show the ratchet tool is operated wherein the handle is located higher than the head.
Figure 3:
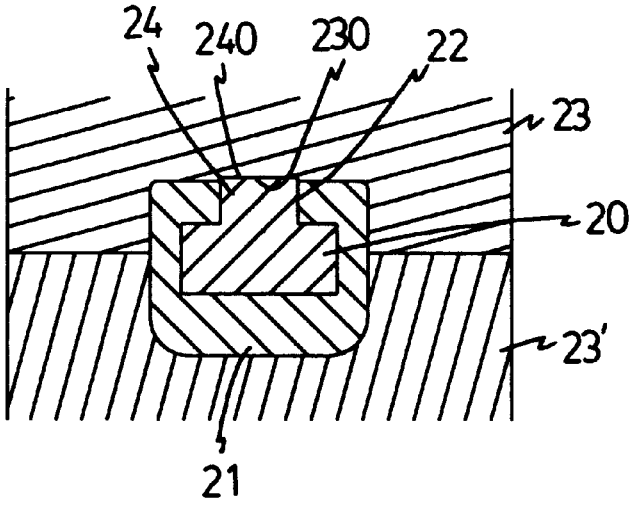
FIG. 3 is an illustrative view to illustrate the grip material is injected between two molds wherein the handle of the ratchet tool is received between the two molds.
Figure 4:
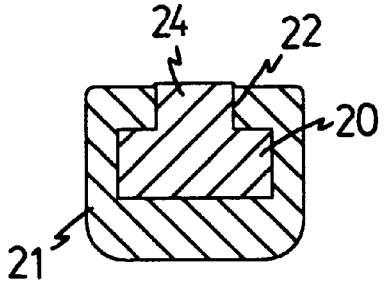
FIG. 4 is an illustrative view to illustrate the top surface of the ridge of the handle is slightly higher than the top surface of the grip material.

Referring to FIGS. 1 to 5, a ratchet tool of the present invention has a head 20 in which a ratchet mechanism is received, a neck 200 extending inclinedly from the head 20, and a handle 201 connected to the neck 200. When using the ratchet tool, a socket 13 is engaged with the head 20 and the handle 201 is located higher than the head so that even if there are other objects 31, 33 located on the surface where a bolt is engaged with the socket 13, the movement of the handle 201 is not limited.

The handle comprises a ridge 24 extending therefrom so as to define two longitudinal grooves 22 between the two sides of the ridge 24 and the outside of the handle 201. The handle 201 is received between a first mold 23 and a second mold 23' wherein a gap is defined between the handle 201, the first mold 23 and the second mold 23' so that the grip material 21 is injected into the gap. The first mold 23 has a shallow recess 230 so that the inside of the shallow recess 230 can contact the top surface 240 of the ridge 24.

Figure 5:
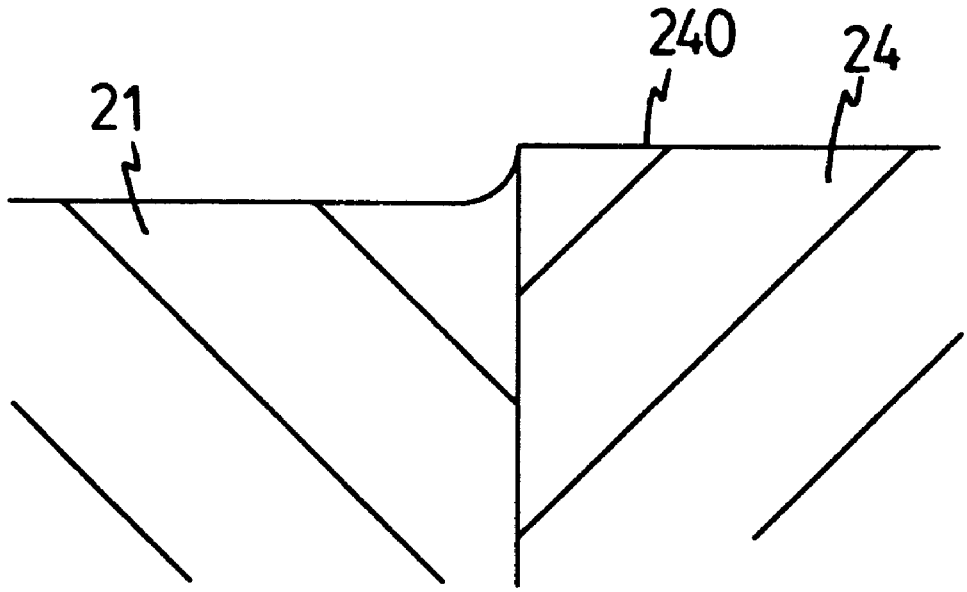
FIG. 5 is a side elevational view, partly in section, of another embodiment of the combination of the handle and the grip material in accordance with the present invention.

When the grip material 21 is injected into the gap and attached to the handle 201. The handle 201 is wrapped by the grip material 21 and some of the grip material is received in the two longitudinal grooves 22. When removing the first mold 23 and the second mold 23' from the handle 201, the top surface 240 of the ridge 24 is located slightly higher than the surface of the grip material 21 received in the two longitudinal grooves 22 as shown in FIG. 5. By this way, there is no flash material formed between the ridge 24 and the grip material 21.

Figure 6:
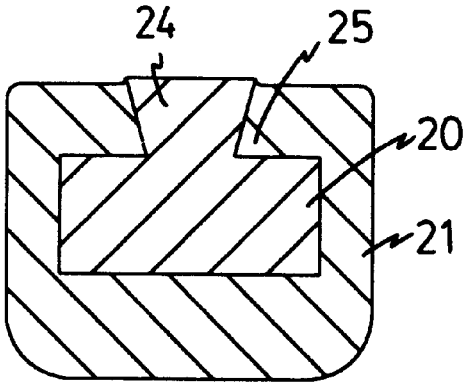
FIG. 6 is a side elevational view, partly in section, of another embodiment of the combination of the handle and the grip material in accordance with the present invention.
Figure 7:
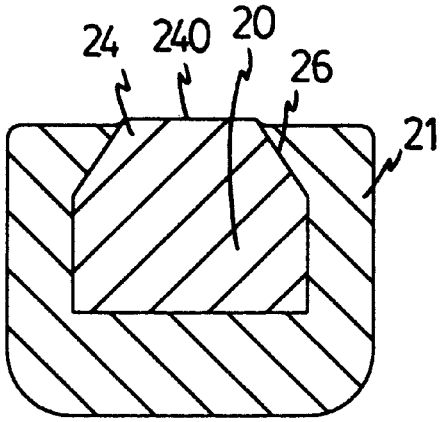
FIG. 7 is a side elevational view, partly in section, of yet another embodiment of the combination of the handle and the grip material in accordance with the present invention.
Figure 8:
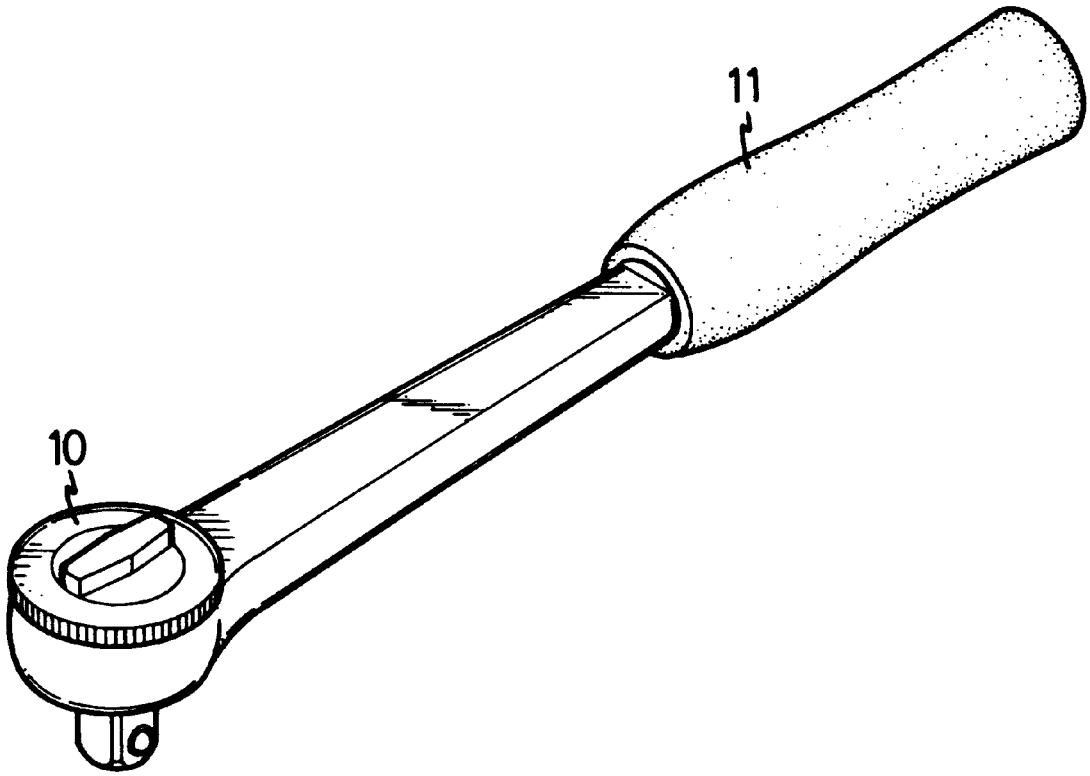
FIG.8 PRIOR ART
FIG. 8 is a perspective view of a conventional ratchet tool with a grip mounted to the handle of the tool.

FIG. 6 shows another embodiment of the handle 201 of the ratchet tool, wherein the two sides of the ridge 24 are tapered sides relative to the top surface of the ridge 24. That is to say, the two grooves can be dove-tailed grooves 25. FIG. 7 shows yet another embodiment of the handle 201 wherein two inclined sides 26 are connected between the two side edges of the top surface 240 of the ridge 24 and the two side edges of the handle portion 20. In other words, the ridge 24 is a trapezoidal ridge. The top surface 240 of the ridge 24 is located slightly higher than the surface of the grip material 21 located on two sides of the ridge 24.

While we have shown and described various embodiments in accordance with the present invention, it should be clear to those skilled in the art that further embodiments may be made without departing from the scope and spirit of the present invention.

What is claimed is:

1. A ratchet tool having a head, a neck extending inclinedly from said head and a handle connected to said neck, said handle extending toward a direction away from said head, said handle having a ridge extending radially outward therefrom, two longitudinal grooves defined between two sides of said ridge and said handle, a grip material attached to said handle and received in said two longitudinal grooves, a surface connected between said two sides of said ridge located higher than a surface of said grip material in said two grooves.

2. The ratchet tool as claimed in claim 1, wherein said two sides of said ridge are tapered sides relative to the top surface of said ridge.

3. A ratchet tool comprising a head and a handle connected to said head, said handle having a ridge extending radially outward therefrom and said ridge having two inclined sides, a surface connected between said two inclined sides, and a grip material attached to said handle and said surface of said ridge located higher than a surface of said grip material located on said two inclined sides of said ridge.

4. The ratchet tool as claimed in claim 3, wherein said ridge is a trapezoidal ridge.

5. The ratchet tool as claimed in claim 3, wherein a neck extends inclinedly from said head and said handle is connected to said neck, said handle extending toward a direction away from said head.

* * * * *